US007270495B1

(12) United States Patent
Preteroti

(10) Patent No.: US 7,270,495 B1
(45) Date of Patent: Sep. 18, 2007

(54) ANNULAR SHAPED DISPENSER OF PERSONAL CARE MATERIAL

(75) Inventor: Dennis Preteroti, Hewitt, NY (US)

(73) Assignee: Jackel, Inc, Hillsborough, NJ (US)

( * ) Notice: Subject to any disclaimer, the term of this patent is extended or adjusted under 35 U.S.C. 154(b) by 0 days.

(21) Appl. No.: 11/525,424

(22) Filed: Sep. 22, 2006

Related U.S. Application Data

(63) Continuation-in-part of application No. 11/484,000, filed on Jul. 10, 2006, now Pat. No. 7,207,739.

(51) Int. Cl.
*B43K 5/06* (2006.01)
*B43K 21/08* (2006.01)

(52) U.S. Cl. ..... 401/175; 401/68; 401/75; 401/172; 222/390

(58) Field of Classification Search ..... 401/55, 401/59, 60, 63, 64, 68, 72, 75, 82, 84, 132, 401/179, 171–176; 222/39, 387, 390, 391
See application file for complete search history.

(56) References Cited

U.S. PATENT DOCUMENTS 4,169,547 A * 10/1979 Newell ..... 401/176
4,545,696 A * 10/1985 Carluccio ..... 401/175
4,915,528 A * 4/1990 Seager ..... 401/68
5,944,434 A * 8/1999 Schlatter ..... 401/82

* cited by examiner

*Primary Examiner*—Tuan Nguyen

(57) ABSTRACT

A dispenser of personal care material adapted to receive and store an insert of personal material and comprising: a vertical hollow circular cylinder having an annular shaped horizontal cross section; an upper cap assembly of annular shape containing a first seal and pressed into removable engagement with an open upper end of the cylinder and producing an air tight upper end seal; a vertical elongated threaded drive screw disposed within the cylinder and spaced from both cylindrical ends; a lower cap assembly including a lower end cap rotatably secured to the lower end of the cylinder; a circular disc that is disposed in an opening, said disc having an inwardly projecting vertical prong which will exhibit an additional forward motion when the disc is manually pressed inward; and air tight seal means disposed in the lower end of the cylinder including a lower end air tight seal.

2 Claims, 3 Drawing Sheets

ANNULAR SHAPED DISPENSER OF PERSONAL CARE MATERIAL

CROSS REFERENCE TO CO-PENDING APPLICATION

This application is a continuation-in-part of application Ser. No. 11/484,000, filed Jul. 10, 2006, which is now U.S. Pat. No. 7,207,739, and entitled DISPENSER OF PERSONAL CARE MATERIAL

FIELD OF THE INVENTION

This invention is directed toward dispensers containing inserts of personal care material.

BACKGROUND OF THE INVENTION

Dispensers generally employ cylinders of circular shape which contain vertical inserts of personal material and have removable top caps which expose the top end of the insert and bottom caps which are manually rotated to continually raise the insert as portions are used up by applications to the body of a user. This process continues until the insert has been fully consumed at which point the dispenser is thrown away and replaced by a new dispenser containing an unused insert.

These dispensers before initial use must be air tight because once the personal material is exposed to air it begins to deteriorate and the dispenser must then be used. Known types of dispensers if stored before use for some period of time will ultimately leak and permit air exposure whereby they can no longer be used.

The co-pending application discloses dispensers so constructed that they cannot leak prior to initial use even if stored for use for extended periods prior to initial use. However, the dispensers so disclosed utilize cylinders of circular cross section because the inserts of personal care material are also of cylindrical shape and circular cross section.

Certain known dispensers utilize cylinders of annular cross section in order to accommodate inserts of personal material having like cylindrical cross section. These known dispensers if stored before use for some period of time will ultimately leak and permit air exposure whereby they can no longer be used. The present invention discloses annular shaped dispensers of personal care material which will not leak air even when stored prior to use for an extended period.

SUMMARY OF THE INVENTION

In accordance with the teachings of this invention, a dispenser of personal care material employs a vertical hollow cylinder having an annular shaped horizontal cross section. The cylinder has a vertical axis and is open at its upper end. The cylinder has a closed lower end with a closed recessed region provided with a circular opening which communicates with the hollow interior of the cylinder.

An upper cap assembly of mating annular shape conforming to the inner shape of the cylinder contains an annular seal and is slidably secured to the upper end of the cylinder to produce an air tight upper end seal.

A vertical elongated threaded drive screw is disposed within the cylinder and is spaced from both ends of the cylinder. The screw is disposed along the cylindrical axis.

A horizontal elevator cup of annular shape conforming to the inner shape of the cylinder has a central opening threadedly engaging the drive screw whereby when the drive screw rotates in one direction member is raised and when the drive assembly rotates in opposite direction the member is lowered.

An inset of personal material can be inserted in the cylinder with the drive screw extending through and engaging the insert in intimate contact.

A rotatable hollow circular cap member assembly is inserted into the circular opening in the closed region in the lower closed end of the cylinder. The member has a bottom surface aligned with the lower end of the cylinder. The member has a centrally disposed opening.

A disc that is movable in the lower cap assembly is disposed in said opening. The disc has an inwardly projecting vertical prong which exhibits an additional forward motion when the disc is manually pressed inward. The disc engages the cap member and is rotatable therewith.

Air tight seal means disposed in the cylinder below the lower end of the screw assembly and above the prong includes a seal cap disposed rotatably with the cap member. The seal cap has a valve seal. The seal has a panel with a hole covered by a sealing film enclosing the opening which communicates with the interior of the cylinder. When the film is sealed to this opening, a lower end air tight seal is produced. The prong when moved forward penetrates the plate and film and destroys the air seal. The prong thereafter remains in locked engagement with the lower end of the drive screw and the penetrated plate.

The disc rotates with the cap member. As the disc rotates, the prong is rotated and rotates the drive screw to raise or lower the elevator cup. An insert is mounted on the cup with the screw extending there through and is raised and lowered with the cup.

As a consequence of this construction, the dispenser will not leak air even when stored prior to use for an extended period.

Additional objects and advantages of this invention will either be explained or will become apparent hereinafter.

DETAILED DESCRIPTION OF PREFERRED EMBODIMENTS

Figure 1:
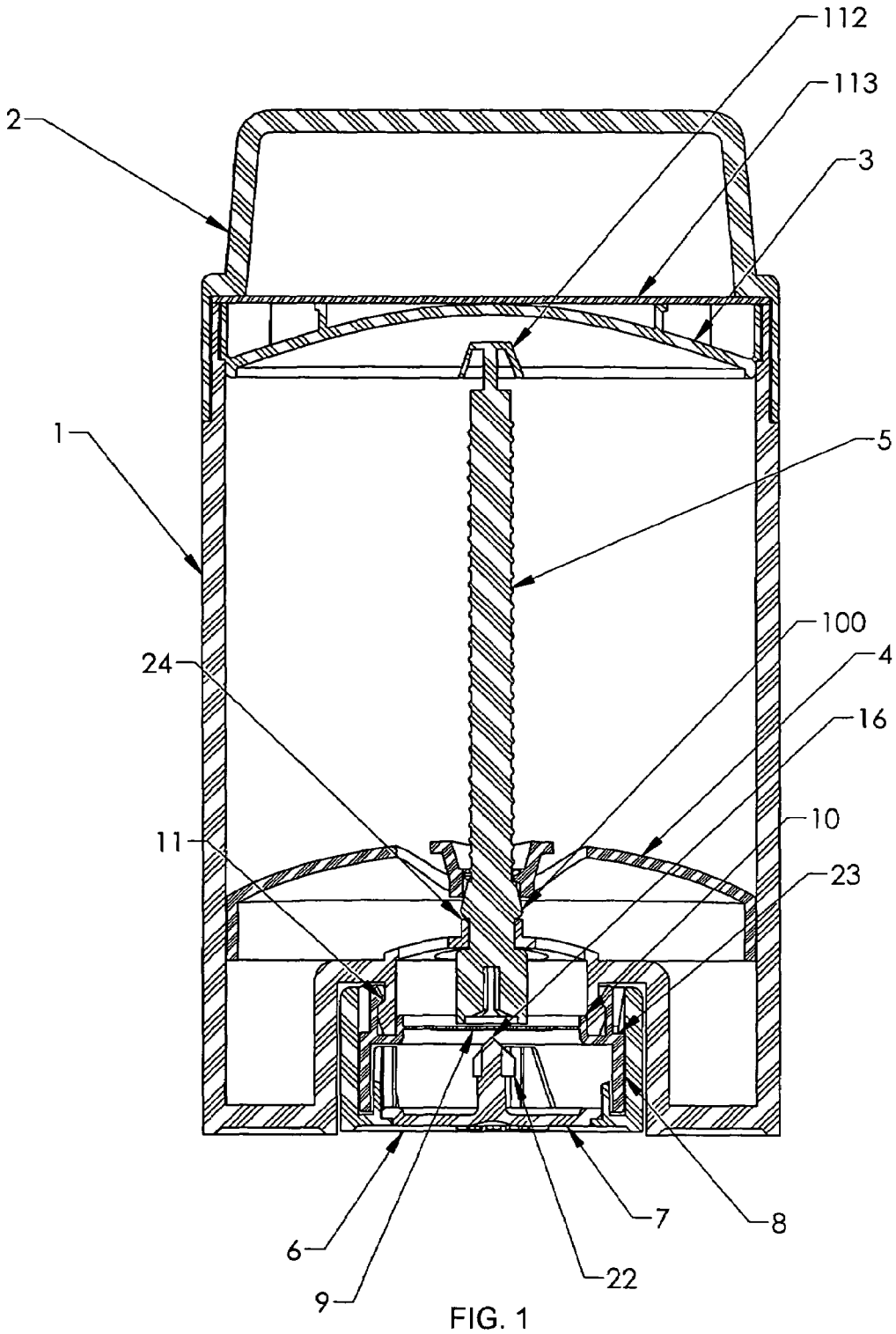
FIG. 1 is a vertical cross-sectional view of a preferred embodiment of the invention.
Figure 2:
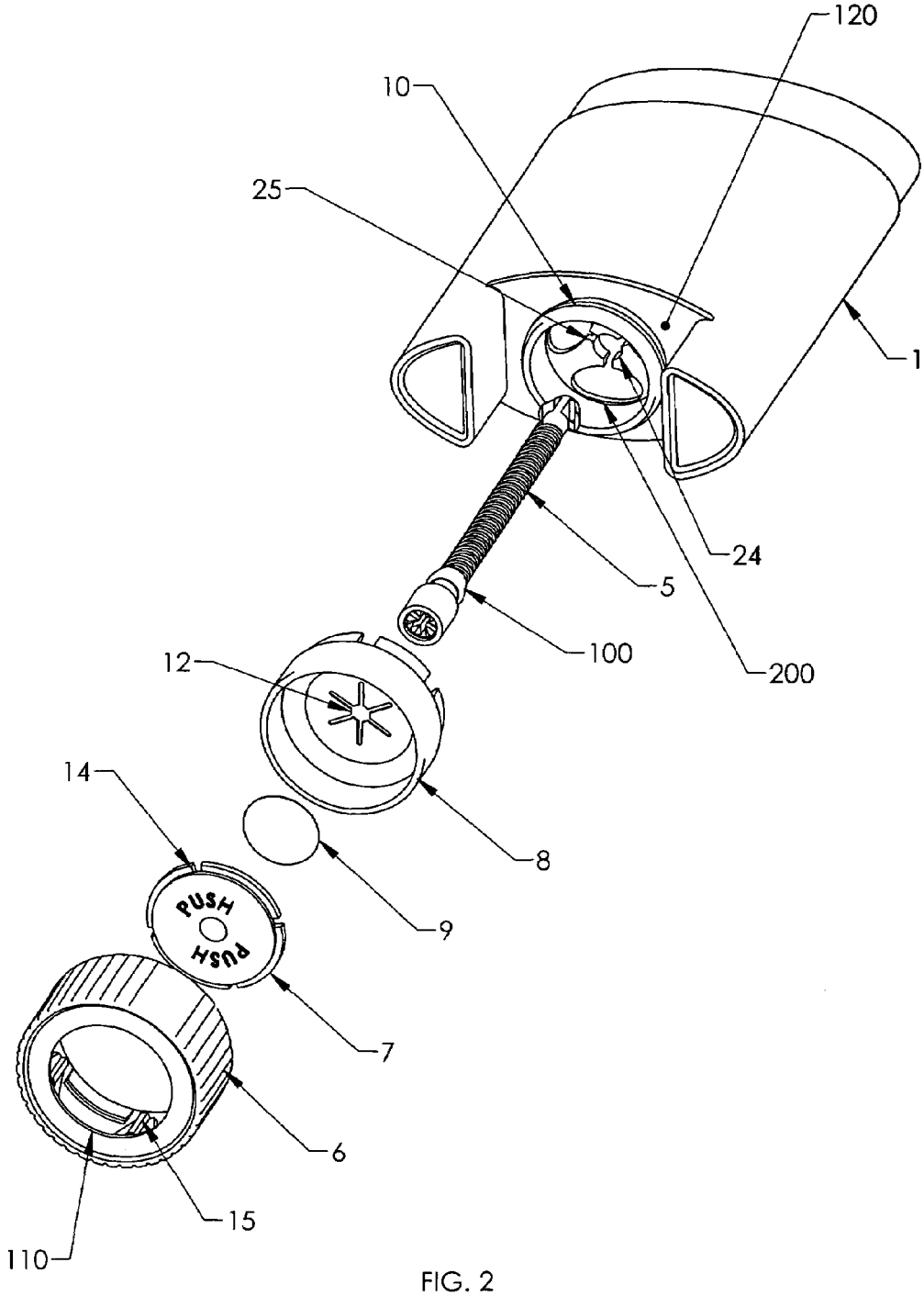
FIG. 2 is an exploded view of the embodiment of FIG. 1.
Figure 3:
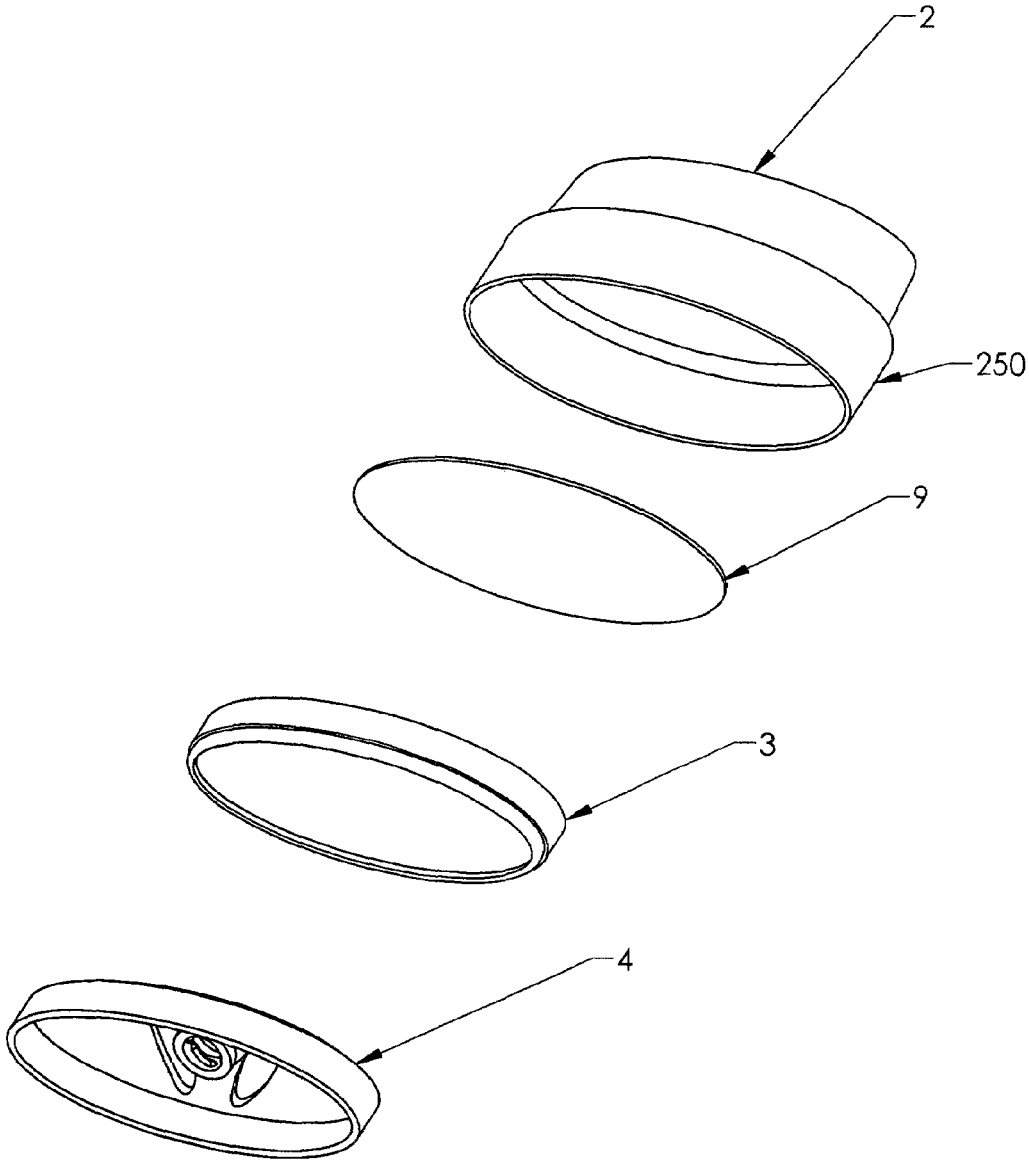
FIG. 3 is an exploded view of the upper cap assembly with the upper annular seal.

FIGS. 1, 2 and 3 show a hollow vertical cylinder 1 having an annular shaped horizontal cross section. The cylinder has a vertical axis and is open at its upper end. The cylinder has a closed lower end with a closed recessed central region 120. A circular opening 200 in this region communicates with the interior of the cylinder.

An upper cap assembly contains an outer cap of mating annular shape 2 with a larger inner cap 250 of mating annular shape and a smaller liner 3. An induction seal 9 is disposed between the liner and the inner cap. This entire assembly is pressed down upon the open top end of the cylinder and forms an air tight upper seal.

A vertical elongated drive screw 5 is disposed in the cylinder along its axis and is spaced from both its ends.

A horizontal elevator cup 4 of mating annular shape has a central opening threadedly engaging the screw 5 whereby when the drive screw rotates in one direction the cup is raised and when the screw rotates in the opposite direction the cup is lowered.

A lower cap assembly includes a hollow base cap 6 of circular cross section is disposed in the central recess and rotatably secured to the open circular end 10 of the cylinder. The base cap has a centrally disposed opening 110 therein.

A push plate 7 is movably disposed in opening 110. The plate 7 has an inwardly projecting vertical prong 16 which will exhibit an additional forward motion when the disc is manually pressed inward. The plate 7 has four slots 14 around its periphery which engage four ribs 15 in the cap 6 so that when cap 6 is rotated, plate 7 will rotate with it.

A seal cap 8 is snapped into base cap 6 that has an undercut 23 around its open front. The seal cap has a round circular valve seal 11. The face of the seal 11 is a thin walled panel with a star shaped hole 12 which is sealed by a foil induction like seal 9.

Push plate 7 has an inward prong 16 shaped to penetrate hole 12. When the plate 7 is pushed inward, prong 16 pierces seal 9 and passes through hole 12 to engage the opening in the lower end of the drive screw. The plate is locked into this engagement by the hole 12 in the seal cap 8. When base cap 6 is rotated, the push plate rotates therewith and rotates the screw, Spaced upwardly inclined ribs of cap 4 extend from the lowered end 10 of the cylinder to a threaded circular core 24 threadedly engaged by screw 5. A portion 100 of the screw immediately above the core is enlarged. The portion 100 establishes a protective lower limit for cup movement. When the cup is raised to its desired upper limit, a protective cap 112 on the upper end of the screw engages the cup and prevents further upward movement.

While the invention has been described in detail with reference to the drawings and detailed description, the protection solicited is to be limited only by the terms of the claims that follow.

What is claimed is:

1. A dispenser of personal care material adapted to receive and store an insert of personal material and comprising:

a vertical hollow circular cylinder having an annular shaped horizontal cross section, the cylinder has a vertical axis, an open upper end and a closed lower end; the lower end of the cylinder having a closed recessed central region with a first central opening therein which communicates with the interior of the cylinder;

an upper cap assembly of annular shape containing a first seal and pressed into removable engagement with the open upper end of the cylinder, the assembly producing an air tight upper end seal; the upper end seal being broken when the assembly is separated from the cylinder;

a vertical elongated threaded drive screw disposed within the cylinder and spaced from both cylindrical ends, said screw being disposed along the cylindrical axis;

a lower cap assembly including a lower end cap rotatably secured to the lower end of the cylinder and disposed in said first central opening, said lower end cap having a second centrally disposed opening;

a circular disc that is disposed in said second opening, said disc having an inwardly projecting vertical prong which will exhibit an additional forward motion when the disc is manually pressed inward, the disc being engaged with and rotatable with the end cap; and air tight seal means disposed in the cylinder below the lower end of the screw assembly and above the prong, said means including a second seal which encloses the first central opening in the cylinder and produces a lower end air tight seal.

2. The dispenser of claim 1 wherein the first seal has an annular shape and the second seal has a circular shape.

* * * * *